US006574940B2

(12) United States Patent
Dauder Guardiola

(10) Patent No.: US 6,574,940 B2
(45) Date of Patent: Jun. 10, 2003

(54) PACKING MACHINES OF PRODUCTS IN MESH BAGS WITH HANDLE

(75) Inventor: Agustín Dauder Guardiola, Badalona (ES)

(73) Assignee: Talleres Daumer, S.A. (ES)

( * ) Notice: Subject to any disclaimer, the term of this patent is extended or adjusted under 35 U.S.C. 154(b) by 0 days.

(21) Appl. No.: 09/918,124

(22) Filed: Jul. 30, 2001

(65) Prior Publication Data

US 2001/0049924 A1 Dec. 13, 2001

(30) Foreign Application Priority Data

Apr. 8, 2000 (ES) ..... P 200001993

(51) Int. Cl.[7] ..... B65B 61/14; B65B 29/04; B65B 1/04; B65B 43/42; B31B 1/86

(52) U.S. Cl. ..... 53/134.1; 53/567; 53/576; 53/413; 493/226; 493/926

(58) Field of Search ..... 53/134.1, 567, 53/570, 576, 413, 450, 350, 411, 135.3, 551; 493/221, 226, 926

(56) References Cited

U.S. PATENT DOCUMENTS 3,507,194 A * 4/1970 Schwarzkopf ..... 493/226
3,719,022 A * 3/1973 Cherio et al. ..... 53/576
3,753,824 A * 8/1973 Bosse ..... 493/926
3,818,810 A * 6/1974 Bosse ..... 493/226
4,230,030 A * 10/1980 Hanson et al. ..... 53/567
5,369,936 A * 12/1994 Callahan et al. ..... 53/135.3
5,466,210 A * 11/1995 Wilcox ..... 53/567
5,609,556 A * 3/1997 Rostalski et al. ..... 493/226
5,729,961 A * 3/1998 Dauder-Guardiola ..... 53/567
6,041,575 A * 3/2000 Vonderhorst et al. ..... 53/135.3
6,068,584 A * 5/2000 Daniels et al. ..... 493/226

FOREIGN PATENT DOCUMENTS

EP 0405595 A1 * 1/1991 ..... B65B/9/15
WO WO 94/12392 A1 * 6/1994 ..... B65B/1/02

* cited by examiner

*Primary Examiner*—Anthony D. Stashick
(74) *Attorney, Agent, or Firm*—Lackenbach Siegel LLP

(57) ABSTRACT

A packing machine for the packing of products in mesh bags with handle include; a tubular mesh feeder, a first set of rollers in quincunxes, a frame with a second set of rollers resting, respectively, on the first set of rollers, feeders of two bands, plates with springs disposed between both bands, parts shaping folds on the free parts of the mesh, rollers that pull the tubular mesh with its two bands welded, and means that close the bottom and cut the top of each bag, feeder rollers of a band and means for transversely cutting the band to obtain a strip, turning means that fold the strip in a "U", and means for inserting the strip in the upper part of the bag and means for welding this set.

2 Claims, 2 Drawing Sheets

PACKING MACHINES OF PRODUCTS IN MESH BAGS WITH HANDLE

FIELD OF THE INVENTION

This invention relates to improvements in packing machines for packing products in mesh bags with handles. The products to be packed may be fruit, vegetables or other food products of all classes and, in general, any product or object to be packed forming a bag, normally with a total weight or predetermined amount. The invention also relates to improvements in packing machines for packing products in mesh bags formed from tubular mesh forming made of plastic material.

BACKGROUND OF THE INVENTION

An automatic machine for the shaping and continuous closing of mesh bags obtained from a tubular netting is known, which is disclosed in the Spanish Invention Patent No. 475.372 granted to Mr. Agustin Dauder Guardiola.

The machine disclosed in the aforementioned Spanish patent is basically characterized by the fact that it includes a set of two vertically disposed telescopic tubes with the inside tube fixed and the outside tube mobile. A third removable tube is placed on the set that carries a certain amount of the tubular mesh. In turn, the set of the three tubes is communicated at the top with a hopper for supplying product to be packed, which product had previously been measured in weight and number.

The mobile tube is activated in the downwardly axial direction by an adjustable stroke cylinder, thereby pulling part of the mesh for shaping a bag with suitable capacity for the amount of supplied product. The mesh is first closed at its base or lower end. The mobile tube is immediately returned to its initial position. There are means that strangle and collect the mesh part. The means includes two sets of blades each which act on both sides of the mesh, moving it in a horizontal transversal plane as regards the axis of the mesh on level with the lower end of the mobile tube in its initial position.

The aforementioned sets of blades are overlapped in their active position. The upper set of blades provides a support for the bottom of the bag that received the product discharged by the hopper. The blades of the upper set have a narrow part that, in collaboration with the angular edge of the blades of the opposite set, shape the strangling of the mesh. On the bottom of the narrow part, there is a cutting and stapling lather head, which is integral with the upper blade set and located on the aforementioned vertical axis of the telescopic set.

Operation of the lather head causes the mouth of the already filled bag and the bottom of the next bag to close. Then the blades are separated and a new cycle is started.

The bags obtained from this machine do not have a handle and each bag is filled with its bottom resting on a stiff support resulting from the set constituted by the upper pair of blades, whereby the first portion of the product to be packed hits the stiff support with the mere overlapping of the mesh.

There is another known machine wherein an additional band to print data (type, class, weight and others) of the products contained in the bags and/or to identify their origin must be added. This band is secured only by welding its two ends and the rest is free. That is, bags without handles are obtained from this machine. Furthermore, the structure of the last mentioned known machine gives rise to a limited performance due to the time it takes to prepare it and the welding.

Also known is a conventional machine supplied by a plastic material band, specifically a mesh material, that cuts a piece of the band at a certain length based on the size of the bag to be obtained, folds it horizontally in the middle and joins it by heat welding or sewing of the vertical ends of the two opposite walls. Normally, two joined handles are respectively fastened to each of the two walls of the bag so obtained.

The resulting bag has the disadvantages of increased fabrication costs, and that it cannot be closed in the case of an eventual and more than possible fall of the products contained therein. Furthermore, the bag cannot be completely filled as its mouth is not closed, and this therefore does not guarantee the content of the bag for the buyer.

According to the above, the upper mouth of this last mentioned bag remains open and does not constitute a closed bag with the products inaccessible to the buyer, the access to which requires breaking the upper part of the bag by conventional means (for example, scissors).

On the other hand, the bags open at the top are used by the buyers for filling them with the products purchased in a shopping center. These open bags are bought in specific shops. In contrast, the closed bags are closed packages once filled and sealed, with the particular products to be sold by the shops in question. In other words, the open bags have another application than that of the closed bags, and their marketing channels are different.

SUMMARY OF THE INVENTION

The packing machine for packing products in mesh bags with handle are provided with improvements that include, in a linked way, supply means of a mesh and side bands, means for shaping the bag provided with means for closing the mesh bag at the heart of a its lower base, means for filling each bag with the corresponding products, means for closing the upper mouth of the filled bags and means for transporting the filled and closed bags towards the exit of the machine.

These improvements are further characterized by the fact they have a set of at least three loose rollers which are horizontally disposed and vertically arranged or disposed, between which a tubular mesh is moved supplied with the interposition of a vertically disposed frame, in turn, with at least three other horizontally disposed loose rollers that rest, respectively, on the corresponding rollers of said set where the tubular mesh is inserted. The packing machine includes two opposite feeders of two thermoplastic material bands located underneath the loose rollers. The packing machine further includes two vertically disposed plates on the frame driven outwards by elastic means that attach them to the respective zone of the inside surface of the mesh, the zones having the respective bands superimposed there against, with welding means heat welding the two sides of each band applied to the mesh. Positioned underneath the welding means are two vertically disposed flat wheels that shape two folds towards the inside of the mesh parts free of the bands.

There are at least two opposed horizontally disposed rollers located below the flat wheels, which rollers turn in opposite directions, applied externally against the set formed by the tubular mesh and the two bands for their transport, with heatwelding means for closing the bottom of a bag. The mesh is then cut at its top portion to form the open end of the bag.

The improvements are further characterized by the fact that once each bag is filled with the desired product and closed at a certain distance underneath its mouth, the packing machine further includes feeder rollers of thermoplastic material bands, means for transversally cutting the bands in strips, two opposite turning lever means on the same plane that fold the strip in an inverted "U" shape with its free ends folded on each other, and other means that insert the folded strip into the upper part of the open mouth of the bag, combined with welds of each part together with the ends of the strip, obtaining the closed bag with the handle.

The improvements in the packing machines of products in mesh bags with handle, according to the invention, provide amongst others the following advantages as regards what is known:

a) The bands are not free as each one is fastened to the mesh of each bag by both sides.
b) There is no mobile tube to push and transport each bag with it being returned in ascent. Instead, there is a lower transport of the mesh with the two bands by pulling with a resulting increase in speed and better performance.
c) The bags obtained have an initially flat handle made of a strip with folds that unfolds when used.
d) The final handle, that is attached to the filled and closed bag, offers the bag carrier a flat part that opens on being unfolded and conveniently adapts itself to the hand and distributes the stress arising from the weight of the filled bag.
e) When the bags are filled with the desired products, their base does not rest on a stiff support, thus products being filled receive better treatment, especially delicate ones.

The improvement in packing machines for packing products in mesh bags with handles provide the advantages described above, apart from others that will be easily inferred from the performance example to be described in detail hereinafter. In order to facilitate understanding of the characteristics mentioned above and at the same time to make known various details, drawings are attached in which a practical performance case is represented as an example and not limitative of the scope of this invention.

DESCRIPTION OF THE INVENTION

It must be taken into account that the following description refers to a static situation of some elements, when in fact and with the packing machine in normal operation, these elements turn or move. However, this will be rendered obvious to one of ordinary skill in the art after reading the description that follows.

Figure 2:
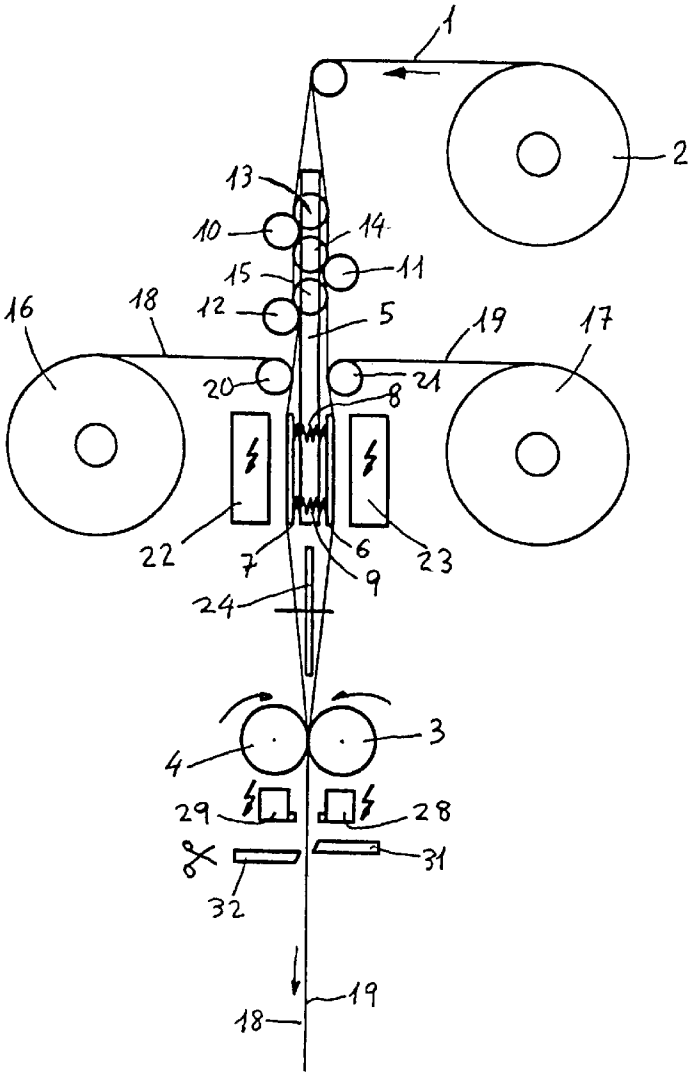
FIG. 2 corresponds to a schematic front elevation view of said packing machine in the zone where the bag is obtained and its lower base or bottom is closed.
Figure 1:
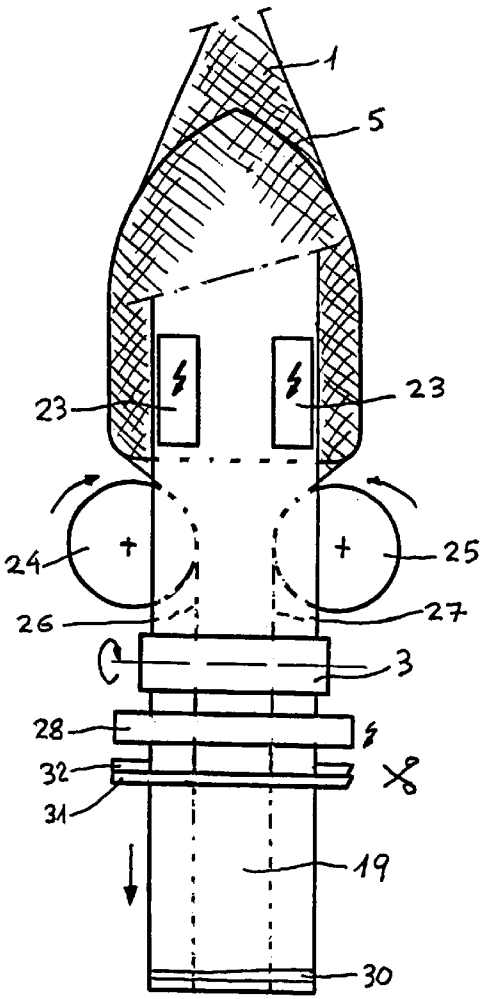
FIG. 1 shows a schematic elevation side view of the zone where the bag is obtained and its lower base or bottom is closed in a packing machine of products in mesh bags provided with the improvements of the invention.

In accordance with FIGS. 1 and 2 of the drawings, the station where the mesh bag is obtained and its lower base is closed in a packing machine provided with the improvements of the invention includes the tubular mesh -1- coming from the reel -2- that is moved downwards due to a pair of rollers -3- and 4-, one of which at least is motorized.

The tubular mesh -1- moves around a vertical frame -5- in the way of a template or form, with a very reduced thickness as regards the width. Thus, the tubular mesh adopts an elongated transverse shape with two very close faces. On the lower part and inside the frame -5-, there are two opposite vertical plates -6- and -7- that are driven towards the outside by elastic means such as the springs -8- and -9-, which push them against the inside faces of the mesh to be moved downwards.

There are a variable number of loose rollers disposed on the chassis of the packing machine, such as the three horizontal rollers -10-, -11- and -12-vertically disposed in quincunxes from top to bottom. The frame or form -5-, in turn, has a variable number of loose rollers, such as the three horizontal rollers -13-, -14- and -15- that respectively rest on the three rollers -10-, -11- and -12-. Between these and the rollers of the frame -5-, the tubular mesh is moved, following a sinuous path (see FIG. 2).

At a certain height and lower than the mentioned sinuous path of the mesh, there are two opposite feeders of both bands, such as the reels -16- and -17- that provide both bands -18- and -19- with thermoplastic material, which by means of two rollers -20- and -21- are superimposed on the descending mesh and then welded by two welding means -22- and -23-. These, in turn, go in pairs (FIG. 1). The welding means heat weld the two sides of each band to the mesh. The bands -18- and -19- may have data imprinted thereon relating to the products to be contained in the bags and their origin. Such data may be on one or two bands.

Underneath the welding means there are two opposed, vertically disposed flat wheels -24- and -25- that form two folds -26- and -27- towards the inside (FIG. 1) parts of the mesh without the bands.

Going always from top to bottom, there is then a variable number of pairs of rollers, such as the pair of opposed, horizontally dispose rollers -3- and -4- that turn in opposite directions and are applied externally against the set constituted by the tubular mesh and the two bands, pulling it downwards.

Thereafter welding means such as the two welders or welding elements-28- and -29- close the free bottom of the mentioned set with a heat weld -30-.

Underneath this are cutting means, such as the cutters -31- and -32-, that cut what will be the end of the upper part of a bag, thus obtaining a bag with its mouth open and with two opposite folds. In FIGS. 1 and 2, the packing machine shows the welds -28- and -29- and the cutting means or cutters -31- and -32- open, that is, in the inactive position, whilst in the description made it is presumed that they are in the active position and coordinated, which is what would happen in reality.

The bags obtained according to the description up to now are transported hanging with their mouths open, which is expanded by conventional means, passing by a filling station with the desired products. Then each filled bag is closed at a certain distance below its mouth, establishing a free, upper and continuous band. The filled and closed bags are transported to the station where the handle is obtained and its union to the mouth of the corresponding bag.

In this last station of the packing machine (FIGS. 3 and 4), there are feeder rollers, such as the rollers -33- (this one motorized) and -34- (pressure). This last roller (which has a spring or other means to maintain a certain pressure against the roller -33- with the element to be moved inserted) is not represented in FIG. 4, where only the mechanisms of the handle obtaining stage and a finished bag are sketched. The rollers -33- and -34- supply a thermoplastic material band -35- in the downward direction coming from a reel -36-.

When a motorized roller is specified, this is understood to be operated by a motor, usually electric and, where applicable, through transmission means.

Next are transversal cutting means -37- of the band -35- in strips -38-. Each strip is transported by a pair of vents -39*a*- and -39*b*- to a motorized roller -40-. This motorized roller is linked, for example, by a chain or cogged belt, to another roller -41- which, in turn, has a plate -42- joined to it that can be moved downwards or upwards. The two vents are placed at the ends of both arms -a- and -b- (FIG. 4).

Figure 4:
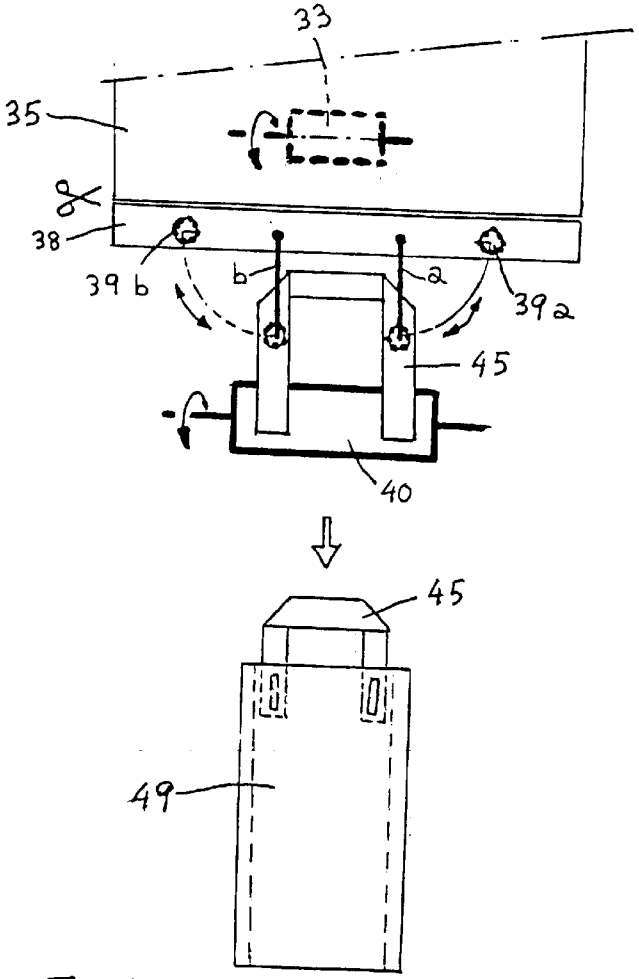
FIG. 4 shows a schematic side elevation view of the packing machine in the zone where the handle is formed and fastened to the mouth of the bag.
Figure 3:
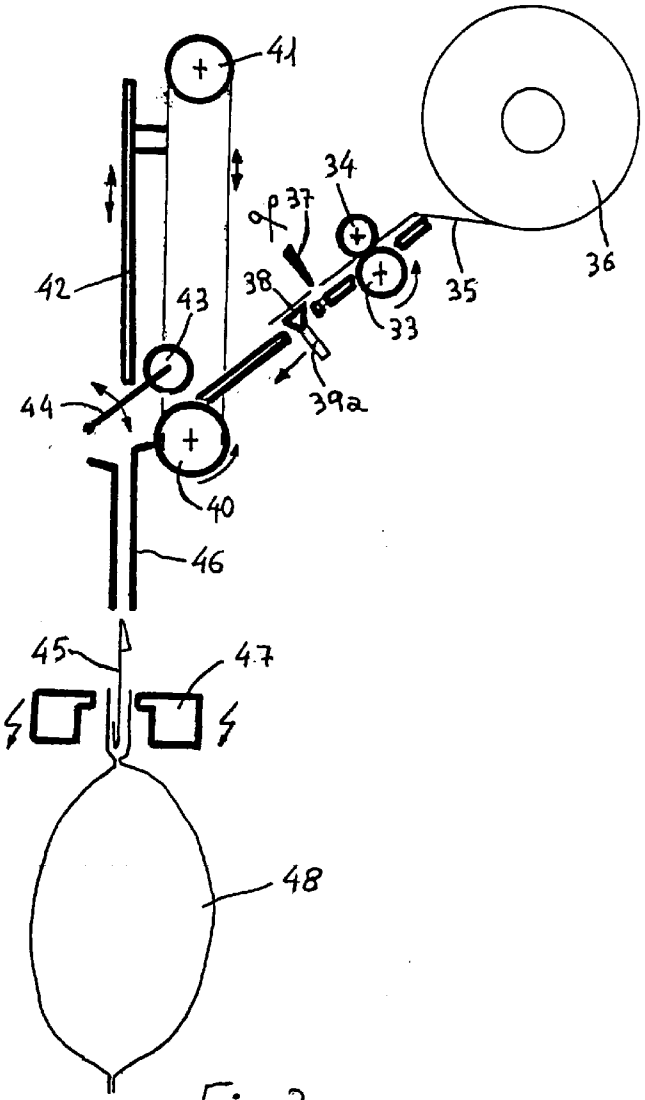
FIG. 3 is a schematic front elevation view of the packing machine in the zone where the handle is formed and fastened to the mouth of the bag.

Once the vents have been attached by vacuum to the strip -38-, their arms make them turn in the opposite direction according to a 90° angle, shaping the handle -45- in an inverted "U" general shape and with the branches folded as represented in FIG. 4. The vents deposit the two ends of the handle on the roller -40-. At this moment, a counter-roller -43- joined to the end of an arm -44-, which may vary according to the arrow of FIG. 3, is applied against the roller -40- with the interposition of the ends of the handle. The vacuum of the vents is broken and the arms -a- and -b- turn in the opposite direction to the one before waiting to receive the next strip.

When the roller -40- is activated, turning according to the arrow of FIG. 3, it pulls the handle -45- downwards, in collaboration with the counter-roller -43-, and at the same time turns the roller -41- causing the plate-42-to descend. The lower end of said plate is applied against the free ends of the handle, resulting in two folds (these are schematically represented in the lower part of the handle -45- of FIG. 3), Moving the handle downwards inside the guide -46- until reaching the welders -47- that fasten it to the upper free band of the bag, prior to inserting the two ends of the handle inside the space delimited by the band (see FIG. 3).

In this way, bags filled with the desired product, closed and provided with a handle for easy carrying are obtained, such as the bag -48- represented in FIG. 3, just before the welders -47- come into operation to fasten the handle and the bag -49- represented in FIG. 4, as the handle is fastened by welding.

It should be mentioned that, during performance of the improvements purpose of this invention, all the detail variations that experience and practice make advisable as regards shapes and sizes, both absolute and relative, materials used and other circumstances of an accessory nature may be applied, as well as whatever constructive detail modifications considered compatible with the essentiality of what is claimed may be introduced, provided they are considered in the spirit of the following claims:

What is claimed is:

1. Improvements in a packing machine for packing product in mesh bags with handles, said packing machine includes means for supplying a mesh and lateral bands, means for shaping the bags including means for closing the lower portion of the bag and means for filling each bag with the product, means for closing the upper end of the filled bags and means for transporting the filled and closed bags towards a machine exit, wherein the improvement comprises:

a set of at least three loose rollers, with each roller horizontally disposed, and said loose rollers being vertically disposed between a tubular mesh which moves downwardly, and a vertically disposed frame is provided, in turn, with at least three other loose rollers in horizontal disposition in juxtaposed to the frame with the tubular mesh inserted between said sets of rollers;

two oppositely disposed feeders of two thermoplastic material bands disposed below the loose rollers;

two oppositely and vertically disposed plates disposed on the frame, and elastic means for outwardly pushing the plates to cause the plates to contact respective zones of the inside surface of the mesh, said respective zones having the respective bands superimposed there against, and welding means for heat welding each band to the mesh;

two vertically and oppositely disposed flat wheels disposed below the welding means that shape two folds in and towards the inside of the mesh free of the bands;

at least two oppositely and horizontally disposed rollers located on the flat wheels that turn in opposite directions, said oppositely disposed rollers being applied against the set formed by the tubular mesh and the two bands for dragging the set downwardly, and heat-weld means for closing the bottom end of the mesh to form the closed end of the bag, and means for cutting the mesh at the top to form the open-end of the bag.

2. The improvements in a packing machine of claim 1, further comprising feeder rollers for feeding said thermoplastic material bands, means for transversally cutting the bands in strips, two oppositely turning lever means that fold the respective strips in an inverted "U" shape with the free ends folded on each other; and means that insert each folded strip into the upper part of the section situated between the said bottom of the bag to form the closed end and the opened end, whereby the strips are welded to the mesh and bottom of the bag, with the upper end then closed after filling the bag with product to form the filled closed bag.

* * * * *